US008651760B2

(12) United States Patent
Gueret

(10) Patent No.: US 8,651,760 B2
(45) Date of Patent: Feb. 18, 2014

(54) DEVICE INCLUDING AN APPLICATOR FOR APPLYING A COSMETIC OR CARE-PRODUCT COMPOSITION

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 13/504,175

(22) PCT Filed: Oct. 14, 2010

(86) PCT No.: PCT/IB2010/054663

§ 371 (c)(1),
(2), (4) Date: Aug. 3, 2012

(87) PCT Pub. No.: WO2011/051852

PCT Pub. Date: May 5, 2011

(65) Prior Publication Data

US 2012/0294665 A1 Nov. 22, 2012

Related U.S. Application Data

(60) Provisional application No. 61/258,244, filed on Nov. 5, 2009.

(30) Foreign Application Priority Data

Oct. 27, 2009 (FR) ..... 09 57531

(51) Int. Cl.
*A46B 11/00* (2006.01)

(52) U.S. Cl.
USPC ..... 401/129; 401/118; 401/121; 401/122

(58) Field of Classification Search
USPC ..... 401/121, 129
See application file for complete search history.

(56) References Cited

U.S. PATENT DOCUMENTS 4,712,936 A * 12/1987 Kessler ..... 401/129
4,784,505 A * 11/1988 Dahm ..... 401/122
6,328,495 B1 12/2001 Gueret (Continued)

FOREIGN PATENT DOCUMENTS

DE 3327405 2/1985
EP 611170 3/1994

(Continued)

OTHER PUBLICATIONS

International Search Report dated Apr. 15, 2011.

*Primary Examiner* — David J. Walczak
*Assistant Examiner* — Joshua Wiljanen
(74) *Attorney, Agent, or Firm* — Pearne & Gordon LLP

(57) ABSTRACT

The present invention relates to a device for applying a composition to human keratinous materials, the device comprising: a container (2) that is provided with a wiper member (7) and that contains a cosmetic or care-product composition (P); an applicator (3) for applying the composition contained in the container, the applicator comprising: an applicator member (5) for applying the composition; a handle (6); and a stem (4) that connects the applicator member to the handle, the stem extending along a longitudinal axis (X) and including a visible portion that presents a cross-section that varies over more than half of its length (l), and that passes through at least one maximum (M) that is situated at a non-zero distance from the ends (4*a*, 4*g*) of the visible portion.

18 Claims, 3 Drawing Sheets

(56) References Cited

U.S. PATENT DOCUMENTS

Figure 1:
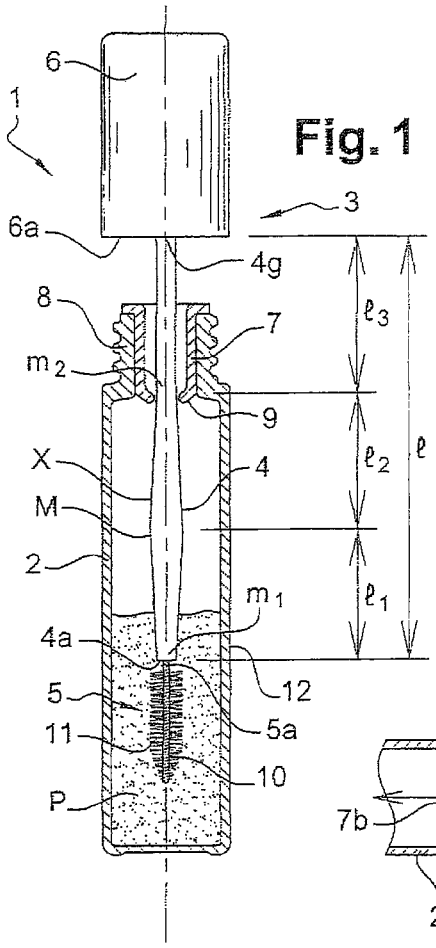

| | | | | |
|---|---|---|---|---|
| 6,375,374 | B2 | 4/2002 | Gueret | |
| 7,077,592 | B2 * | 7/2006 | Gueret | 401/128 |
| 7,455,468 | B2 | 11/2008 | Gueret | |
| 2004/0258453 | A1 | 12/2004 | Gueret | |
| 2005/0028834 | A1 | 2/2005 | Ramet | |
| 2005/0175394 | A1 | 8/2005 | Gueret | |
| 2005/0232681 | A1 * | 10/2005 | Gueret | 401/129 |
| 2010/0111589 | A1 * | 5/2010 | Bauer et al. | 401/122 |

FOREIGN PATENT DOCUMENTS

| | | | |
|---|---|---|---|
| EP | 0694266 | | 1/1996 |
| EP | 0694266 | A1 | 1/1996 |
| EP | 1046358 | | 10/2000 |
| EP | 1046358 | A1 | 10/2000 |
| EP | 1066771 | | 1/2001 |
| EP | 1477083 | | 11/2004 |
| EP | 1498046 | | 1/2005 |
| EP | 1498046 | A1 | 1/2005 |
| EP | 1504691 | | 2/2005 |
| EP | 1584260 | | 10/2005 |
| EP | 1584260 | A2 | 10/2005 |
| EP | 1738894 | | 1/2007 |
| EP | 1797789 | | 6/2007 |
| EP | 1836924 | | 9/2007 |
| EP | 1917883 | | 5/2008 |
| EP | 2027792 | | 2/2009 |
| EP | 2070436 | A1 | 6/2009 |
| FR | 2155192 | | 5/1973 |
| FR | 2926012 | | 7/2009 |
| GB | 2099374 | | 12/1982 |

* cited by examiner

DEVICE INCLUDING AN APPLICATOR FOR APPLYING A COSMETIC OR CARE-PRODUCT COMPOSITION

The present invention relates to a device for applying a composition to human keratinous materials, in particular keratinous fibers, such as eyelashes or eyebrows, the device comprising: a container that is provided with a wiper member; and an applicator comprising an applicator member that is disposed at the end of a stem. The invention relates more particularly, but not exclusively, to applicators for applying a makeup or care-product composition to the eyelashes or the eyebrows, in particular mascara.

In some known devices, insertion or removal of the applicator is accompanied by a variation in the pressure inside the container, as a result of a piston phenomenon of the stem acting as a piston rod in contact with the wiper member. During removal, the suction created in the container may cause a sucking noise, and may project residues of composition present on the wiper member towards the applicator member, thereby degrading the quality of the makeup effect. While the applicator is being inserted into the container, the increased pressure may oppose insertion of the applicator and cause composition to accumulate in the wiper member.

Applicators are known comprising stems of diameters that are relatively large, e.g. close to the diameters of the applicator members, and that require wiper members to be used that have wiper orifices of diameters that are large.

Applicators are also known comprising fine stems that make it possible to see the applicator member easily while applying makeup and to avoid the piston phenomenon, but such stems are not always wiped in completely satisfactory manner. The diameter of the wiper orifice cannot be as small as the diameter of the stem without decreasing loading and the amount of time the applicator can be used before being returned to the container.

There also exist stems that are provided with a constriction for preserving the wiper member by not deforming it in the storage position. The return of the container to atmospheric pressure may be delayed while the applicator is being inserted into the container, and the user may feel an uncomfortable jerk.

There also exist "cleaning" stems that comprises a projection that makes it possible to push composition that has been deposited on the wiper member by the applicator member, back into the container while the applicator is being inserted therein. Such a projection may cause excess composition to accumulate at the outlet from the container, may turn out to be unattractive, and may cause a jerk while the applicator is being removed from the container or being inserted therein.

Patent applications EP 1 477 083, EP 1 738 894, EP 2 027 792, and EP 1 504 691 disclose applicators each having a stem that includes a constriction that makes it more deformable and/or flexible. The stems of such applicators are of cross-section that is constant, except at the constriction.

In addition, patent application DE 33 27 405 relates to an eyeliner applicator having a stem that includes a portion of small diameter, and that is fitted with a spongy body for storing the composition.

Applications EP 1 797 789 A2 and GB 2 099 374 describe applicators including stems having visible portions of cross-sections that decrease towards the applicator members.

There exists a need to improve known devices still further, so as to favor obtaining satisfactory wiping, and so as to remove the applicator member easily from the container containing the composition and to insert it easily therein.

There also exists a need to be able to master applying composition to the eyelashes, while looking at oneself in a mirror.

Exemplary embodiments of the invention thus provide a device comprising:

- a container that is provided with a wiper member and that contains a cosmetic or care-product composition;
- an applicator for applying the composition contained in the container, the applicator comprising:
  - an applicator member for applying the composition;
  - a handle; and
  - a stem that connects the applicator member to the handle, the stem extending along a longitudinal axis and comprising a visible portion that presents a cross-section that varies over more than half of its length, and that passes through at least one maximum that is situated at a non-zero distance from the ends of the visible portion, in particular at a distance which is greater than ⅛ of the length of the visible portion, or even greater than ⅙, or than ¼, or even than ⅓.

The term "cross-section" means the outside section of the stem measured locally perpendicularly to its longitudinal axis, which axis may be rectilinear or curved. A cross-section that varies is a cross-section having a greatest dimension that varies. For a circular cross-section, the greatest dimension would be the diameter.

The term "visible portion of the stem" means the portion of the stem that is visible when the stem is vertical and observed along a horizontal direction of observation. The stem may comprise a non-visible portion that extends inside the handle. In exemplary embodiments of the invention, all of the visible portion of the stem may be engaged in the container when the applicator is in place in the container.

The device may be configured such that the wiper member wipes the stem when the applicator is separated from the container.

The stem, in particular the visible portion of the stem, may be molded in its final shape.

In a variant, the stem may be obtained by machining.

The stem may present a shape that may be circularly symmetrical, or not circularly symmetrical.

The shape of the stem of the invention, with its cross-section that varies, may give the user better control over the movements used to apply makeup, since the user can observe the applicator member easily during application, with it being possible for the stem to retain a relatively fine section in the proximity of the applicator member.

By means of the presence of a cross-section maximum along the stem, said stem may clean the inside of the wiper member while the applicator member is being inserted into the container, thereby reducing the risk of the wiper member becoming clogged. The applicator may progressively entrain some residues of composition that are retained in the wiper member into the container, while the applicator member is being returned thereto, and it may do this without any jerking. By way of example, the stem may come into contact with the edge of the wiper lip, at least where the section of the visible portion of the stem passes through its maximum.

The invention further makes it possible to obtain a stem that is wiped relatively well, since the section of the stem may come into contact with the wiper member over a distance that is not negligible.

In addition, an applicator of the invention may enable the container to return to atmospheric pressure quite quickly while the applicator member is being inserted into the container or being removed therefrom, when the visible portion of the stem is made for this purpose, e.g. with two regions that are sufficiently fine on either side of the maximum. Finally, the applicator of the invention makes it possible not to deform the wiper member while the applicator is being stored in place on the container, since the stem may be relatively fine in its region that comes to be positioned facing the wiper member. For example, the visible portion of the stem need not come into contact with the edge of the wiper lip, at least where the cross-section of the stem presents a relative minimum. In exemplary embodiments of the invention, the stem presents a cross-section that, at at least two points along the longitudinal axis of the stem, is smaller than the section of the wiper orifice of the wiper member.

In spite of its varying cross-section, the stem may remain sufficiently rigid to avoid deforming visibly, e.g. it may remain rectilinear, while the composition is being applied by means of the applicator member. The region(s) of the stem in which the cross-section is at a minimum may thus remain sufficiently large, so as to avoid behaving like hinges.

The visible portion of the stem may comprise a single maximum on a segment that extends over more than one-fourth of the length of the visible portion of the stem, or even over more than one-third, or even over more than half of the length of the visible portion of the stem, or even over the entire length of the visible portion.

The cross-section of the visible portion of the stem may increase then decrease along its longitudinal axis. The combined length of the stem segments for which the cross-section varies may be greater than two-thirds, or even greater than three-fourths, of the length of the visible portion of the stem. The cross-section of the stem may vary over its entire visible length, where appropriate.

The greatest transverse dimension, e.g. the diameter for a stem of circular section, of the visible portion of the stem may be greater than or equal to 5 mm.

The maximum of the greatest transverse dimension of the visible portion of the stem, e.g. the maximum diameter, may lie in the range 4.5 millimeters (mm) to 8 mm, or even in the range 5.5 mm to 6.5 mm, e.g. being 6 mm.

At least one maximum of the cross-section of the stem may be situated between two minima of the cross-section of the visible portion of the stem. Two successive minima may be spaced apart by more than one-fourth, or even by more than one-third, or even by more than half of the length of the visible portion of the stem.

The distance separating a minimum from a maximum of the cross-section of the visible portion of the stem may be greater than one-fourth of the length of the visible portion of the stem, or even greater than one-third. Thus, the variation in the cross-section between a minimum and a maximum may be relatively slow. The slope formed by the stem between the maximum and the minimum may be relatively gentle. That makes it possible to improve the appearance of the applicator and to encourage wiping that is smooth, without jerking. The slope is less than or equal to 30°, for example. By way of example, the visible portion of the stem may comprise two oppositely-directed conical portions that touch at their bases and that extend on either side of the maximum.

The greatest transverse dimension of the distal end of the visible portion of the stem may be strictly less than the maximum of the greatest dimension of the cross-section of the visible portion of the stem.

In the presence of a plurality of minima, one of the minima of the cross-section may be situated at the distal end of the visible portion of the stem. The presence, at this location, of a minimum of the cross-section of the stem makes it possible to encourage the intake of air while the applicator is being removed from the container containing the composition.

The minima may advantageously be obtained other than by die-stamping the stem, in particular they may be obtained by molding the stem.

The stem may comprise a distal portion that is elastically deformable. By way of example, the distal portion may be formed by an endpiece that is fitted on the remainder of the stem and that may be made out of a material that is more rigid. The endpiece may comprise one or more annular grooves, thereby imparting more flexibility thereto.

At least one cross-section of the stem may be of shape selected from the following list: circular; non-circular; indented. The stem may comprise one or more longitudinal grooves. At least one longitudinal groove may extend over more than one-fourth, or even over more than one-third, better over more than half of the length of the visible portion of the stem. The stem may be axially symmetrical, or even circularly symmetrical.

The stem may be molded integrally with fastener means for fastening to the handle, or it may even be molded integrally with all or part of said handle. The stem may be molded integrally with an inner cap that may or may not comprise a thread for screw-fastening on a neck of the container. Where appropriate, the stem may be molded integrally with all or part of the applicator member. The visible portion of the stem may be a single part that is made out of a single thermoplastic material.

A greatest dimension in cross-section of the envelope surface of the applicator member, e.g. a twisted-core brush, may be greater than or equal to 10 mm.

The greatest transverse dimension of the stem may be selected as a function of the applicator member, so as to obtain the best wiping result.

By way of example, the wiper member may be disposed in a neck of the container.

The wiper member may define a wiper orifice having a diameter that is smaller than the greatest dimension of the stem, in cross-section and along the visible portion of the stem, at least one point, or even over more than one-fourth, one-third, or half of the length of the visible portion. The diameter of the wiper orifice is the diameter of the smallest circle that circumscribes the edge of the wiper orifice, observed in projection along the longitudinal axis of the stem, when the edge of the wiper orifice is not circular.

The greatest transverse dimension at said maximum may be greater than the diameter of the wiper orifice. In other words, for a wiper member that defines a wiper orifice of circular section, and for a stem of circularly-symmetrical shape, the greatest diameter of the visible portion of the stem is greater than the smallest diameter of the wiper orifice. By way of example, it may be at least 1 mm greater than the wiper orifice.

At least one of the minima of the cross-section of the stem may have a greatest dimension, e.g. a diameter, that is less than or equal to the diameter of the wiper orifice. In other words, in two regions that are situated on either side of the maximum, the stem may present a diameter that is smaller than the diameter of the wiper orifice.

Beside the handle, the cross-section of the visible portion of the stem may pass through a minimum of cross-section that is smaller than the section of a wiper orifice of the wiper member.

The visible portion of the stem may present a circular cross-section of diameter passing from a value lying in the range 2 mm to 4 mm, e.g. 3 mm to 3.5 mm, to a value lying in the range 5.5 to 7 mm, then to a value lying in the range 2 mm to 4 mm, e.g. 3 mm to 3.5 mm, on going from one end of the visible portion to the other.

Beside the applicator member, the cross-section of the visible portion of the stem may pass through a minimum of section that is smaller than the section of a wiper orifice of the wiper member.

The wiper member may comprise a wiper orifice that may be of shape selected from the following list: circular; non-circular; polygonal; undulating; slotted.

The wiper member may be made out of an elastomer material.

The handle of the applicator may be used as a closure cap for closing the container. The handle and the container may co-operate with each other by screw-fastening, for example. The container may be closed in leaktight manner by the handle of the applicator.

The applicator member may be different from a twisted-core brush and may be made by molding, e.g. as a single piece, in particular by injection-molding, or by molding applicator elements on a core.

The invention also provides a method of manufacturing a device as defined above, wherein the stem is molded in its final shape.

The invention also provides a cosmetic treatment method, in particular a method of applying makeup, for the eyelashes or the eyebrows, the method comprising the step consisting in applying a composition to the eyelashes or the eyebrows by means of a device as defined above.

Figure 3:
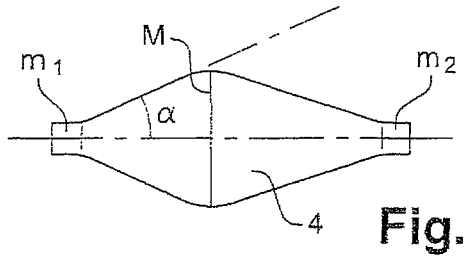
Figure 5A:
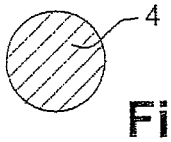
Figure 5B:
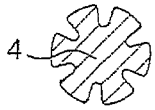
Figure 6A:
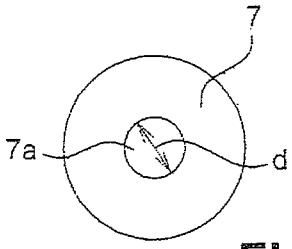
Figure 6C:
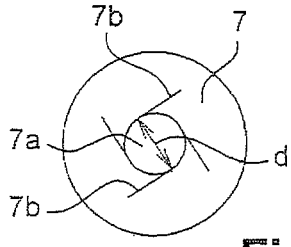
Figure 6B:
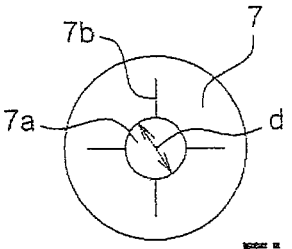
Figure 6D:
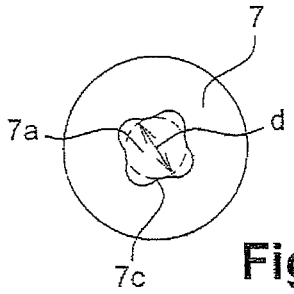
Figure 6E:
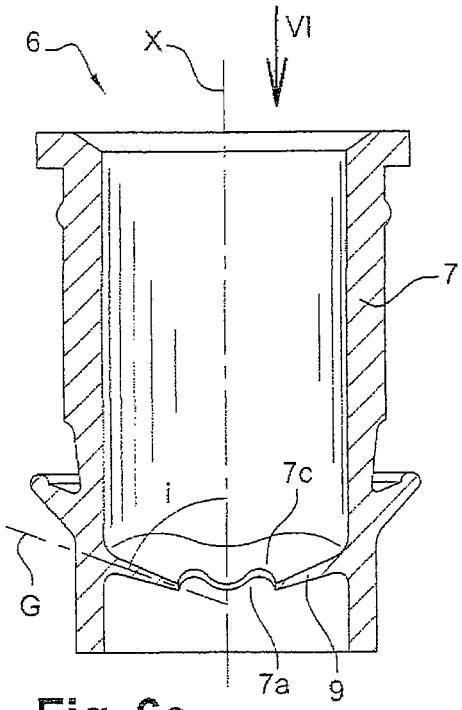

The invention can be better understood on reading the following description of non-limiting embodiments thereof, and on examining the accompanying drawings, in which:

FIG. 1 shows an example of a device of the invention;

FIGS. 2*a* to 2*d* show the FIG. 1 device in use;

FIG. 3 is a diagrammatic and fragmentary view of a variant embodiment;

FIGS. 4*a* to 4*d* are views similar to FIG. 1, showing variant embodiments;

FIGS. 5*a* and 5*b* are diagrammatic and fragmentary cross-sections of variant embodiments;

FIGS. 6*a* to 6*d* show variant embodiments of wiper orifices;

FIG. 6*e* is a longitudinal section of the FIG. 6*d* wiper member; and

Figure 7A:
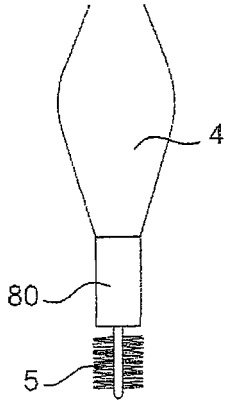
Figure 7B:
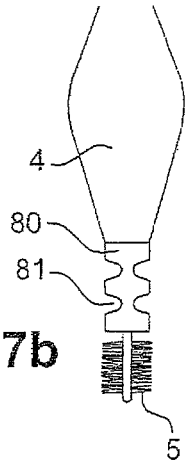

FIGS. 7*a* and 7*b* show two variant embodiments of the distal end of the stem.

FIG. 1 shows an example of a device 1 for applying a cosmetic composition. As shown, the device 1 comprises a container 2 containing the cosmetic composition P for application, and an applicator 3 comprising a stem 4, e.g. of circular cross-section, that is provided at its distal end 4*a* with an applicator member 5, and that is connected at its proximal end to a handle 6 that also constitutes a closure cap for closing the container 2.

As can be seen in FIG. 1, the container 2 comprises a wiper member 7, e.g. constituted by an elastomer part that is inserted into the neck 8 of the container. The wiper member may optionally be conventional, indeed it may be adjustable.

As shown, the neck 8 may comprise an external thread for co-operating with an internal thread of the handle 6 for fastening the applicator 3 on the container 2 and for closing the container 2 in leaktight manner. By way of example, the handle 6 is arranged so as to close the container 2 in leaktight manner, once said handle has been screwed home on the neck 8.

As in the embodiment described, the stem 4 may present a rectilinear longitudinal axis X that coincides with the longitudinal axis of the container 2 when the applicator is fastened thereon.

In FIG. 1, the stem 4 comprises a visible portion 4*e* of length $\lambda$ that extends axially between the applicator member 5 and the bottom end 6*a* of the handle 6, the ends of the visible portion 4*e* being referenced 4*a* and 4*g*. The length $\lambda$ lies in the range 30 mm to 60 mm, for example.

In the embodiment described, the visible portion 4*e* of the stem 4 presents a cross-section that is not constant along the longitudinal axis X of the stem. More precisely, and as shown, it may increase from the distal end 4*a* of the stem, then decrease towards the handle 6.

The visible portion 4*e* of the stem 4 may be of cross-section that is circular, and the greatest dimension of the cross-section at a point corresponds to the outside diameter at said point.

A greatest dimension of the cross-section of the visible portion 4*e* of the stem 4 varies over more than half of the length $\lambda$.

In the embodiment under consideration, the greatest dimension of the cross-section increases over a length $\lambda_1$ between a minimum $m_1$ that is situated at the distal end 4*a* and a maximum M, then decreases over a length $\lambda_2$ between the maximum M and a minimum $m_2$, towards the handle 6. As shown, the stem 4 may include a stem segment of length $\lambda_3$ of constant cross-section that corresponds to the minimum $m_2$. In the embodiment under consideration, the length $\lambda_1+\lambda_2$, over which the cross-section of the stem is not constant, is greater than the length $\lambda_3$ of the stem, over which the cross-section of the stem is constant. The length over which the cross-section is at its maximum may be substantially short at one point, or it may be longer. The maximum M may be situated in the distal half of the visible portion or elsewhere.

Figure 2A:
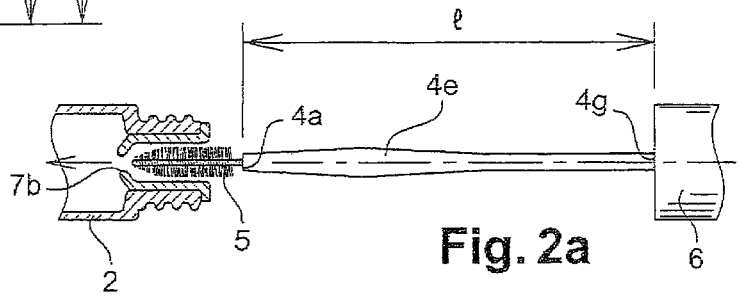
Figure 2B:
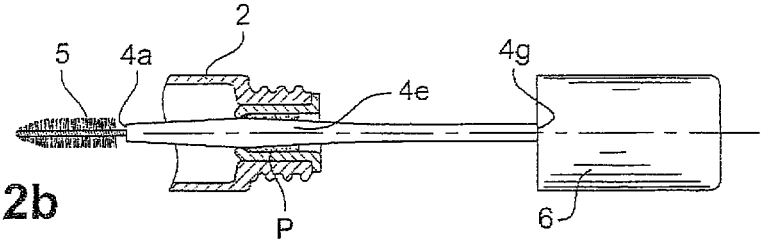
Figure 2C:
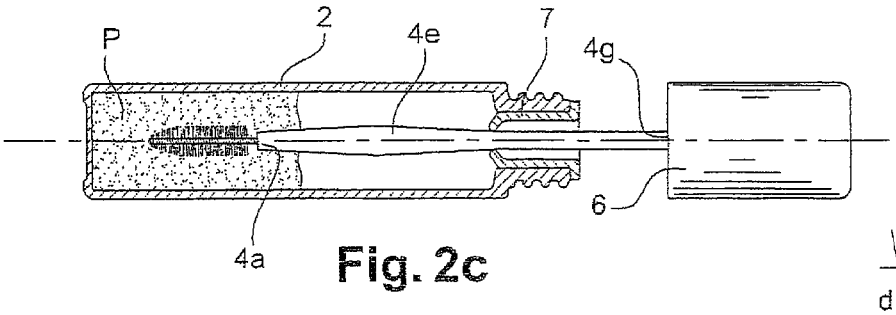
Figure 2D:
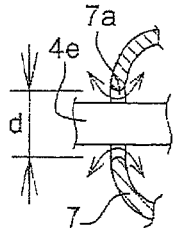

In the embodiment shown, the cross-section of the visible portion 4*e* of the stem 4 passes through a single maximum M as described above, and through two minima $m_1$ and $m_2$, with one of them, $m_1$, being situated at the distal end 4*a* of the stem, and the other one, $m_2$, being situated on the segment of constant cross-section. This could be different, as described below. The presence of the maximum M makes it possible to push the residues of composition present in the wiper member progressively into the container while the applicator is being returned, as shown in FIGS. 2*a* and 2*b*. The presence of the second minimum $m_2$ makes it possible for the container to return to atmospheric pressure when the applicator is fully inserted in the container, as shown in FIGS. 2*c* and 2*d*, with FIG. 2*d* showing a detail of FIG. 2*c*. The first minimum $m_1$ makes it easier for the container to return to atmospheric pressure while the applicator is being removed, before the applicator member passes through the wiper member.

The slope formed by the stem between the minimum $m_1$ or $m_2$ and the maximum M may be relatively gentle. The slope angle $\alpha$ is less than 30°, for example. In FIG. 3, the angle a is exaggerated for the purpose of clarity. The angle may be different above and below the maximum. The slope between the minimum $m_1$, situated closest to the applicator member, and the maximum may be gentler than the slope between the maximum and the minimum $m_2$, situated closest to the handle. The first slope angle may be about 4°, and the second slope angle may be about 8°, for example.

Figure 4A:
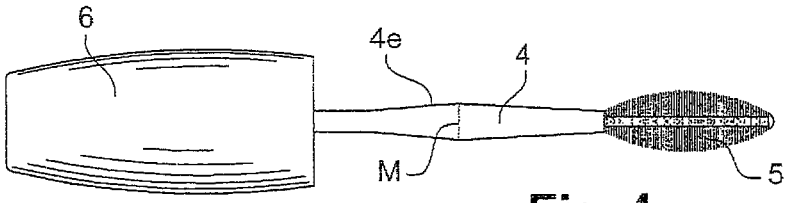
Figure 4B:
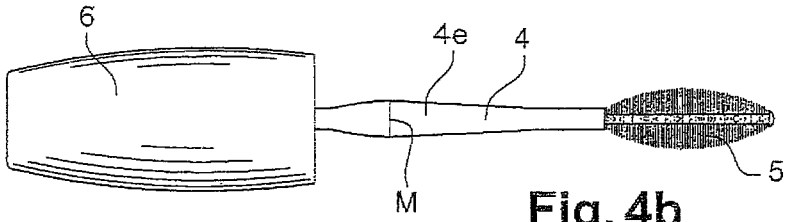

FIG. 4*a* shows a stem 4 comprising a maximum M that is situated in a central region of the visible portion 4*e* of the stem, and FIG. 4*b* shows a stem including a maximum M that is situated beside the proximal end of the visible portion of the stem, i.e. closer to the handle 6 than to the applicator member 5.

Figure 4C:
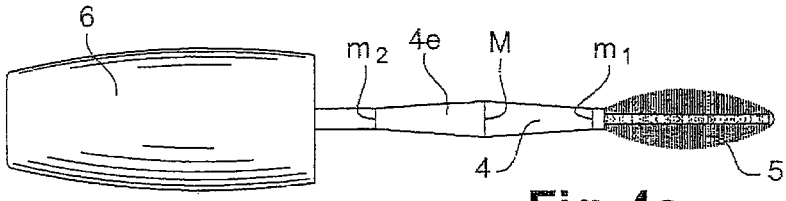

As in the embodiment shown in FIG. 4*c*, the cross-section of the visible portion 4*e* of the stem 4 at the minimum $m_1$ adjacent to the applicator member may be slightly greater than the cross-section of the visible portion of the stem at the minimum $m_2$ adjacent to the handle.

Figure 4D:
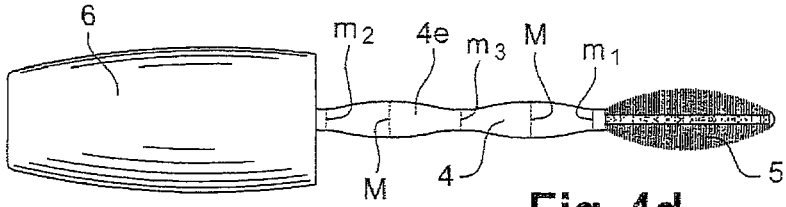

Finally, the stem 4 may comprise two maxima M and three minima $m_1$, $m_2$, and $m_3$, as shown in FIG. 4*d*. In FIG. 4*d*, it can be seen that the cross-section of the visible portion 4*e* increases from the handle 6, reaches a first maximum M, then decreases, passes through the minimum $m_3$, increases once again, passes through the second maximum M, then decreases towards the applicator member 5.

When the stem is observed from the side, as in FIGS. 4*a* to 4*d*, the profile of the stem may be generally biconical, egg-shaped, or hourglass-shaped, depending on the example.

The cross-section of the stem may be of shape that is circular, as shown in FIG. 5*a*, or it may be of some other shape. By way of example, it may include indentations, as shown in FIG. 5*b*. By way of example, the stem 4 may include longitudinal grooves that extend over a fraction of the length λ of its visible portion, e.g. over more than half of the length of the visible portion of the stem.

Along its visible portion 4*e*, the stem 4 may be of cross-section that is solid or hollow.

Dimensions of an example of an applicator of the invention are given below by way of example. The applicator member may have a greatest transverse dimension of about 10 mm, in particular at its central portion. It may further include a distal portion of shape that is frustoconical, tapering towards the free end of the applicator member, with a greatest transverse end dimension of about 4 mm. The applicator member may also include a bevel, where it connects to the stem, of greatest transverse dimension of about 5 mm. The maximum of the greatest transverse dimension of the visible portion of the stem may be about 6 mm, e.g. a diameter lying in the range 6 mm to 6.5 mm, and the minimum may lie in the range about 1.5 mm to 3.5 mm, or even in the range 2.5 mm to 3.5 mm, better in the range 3 mm to 3.5 mm. By way of example, the visible portion 4*e* of the stem may have a length λ lying in the range about 30 mm to 60 mm.

The wiper member may be made out of elastomer.

By way of example, the wiper member may comprise a wiper orifice of shape that is circular, as shown in FIG. 6*a*, and it may be slotted, as shown in FIGS. 6*b* and 6*c*. In FIG. 6*b* the slots are radial, and in FIG. 6*c* the slots are tangential to the wiper orifice.

By way of example, the diameter d of the wiper orifice 7*a* of the wiper member 7 may lie in the range 3 mm to 5.5 mm, e.g. about 4.5 mm or 5 mm.

The wiper member 7 may possibly comprise undulations 7*c*, as shown in FIGS. 6*c* and 6*d*, enabling the wiper orifice to widen more easily when the applicator member passes therethrough. FIG. 6*d* is a view of the wiper orifice as seen looking along arrow VI in FIG. 6*e*.

The wiper orifice may be defined by an undulating wiper lip 9, having an inside free edge that defines the wiper orifice 7*a*, as shown in FIG. 6*e*. The wiper member 7 may include a number of undulations 7*c* lying in the range 3 to 12, for example. The wiper lip 9 may extend generally along a cone that converges towards the bottom of the container, having a generator line G that forms an angle i with the longitudinal axis of the container. While the applicator member is passing through the wiper orifice, the diameter of the wiper orifice increases from 4 mm to 5.5 mm, for example, without excessively deforming the wiper member, by deploying the undulations.

In a variant, the wiper lip 9 may extend generally along a mid-plane that is perpendicular to the axis X, or even generally along a cone that converges towards the outlet of the container.

The wiper member may be made in some other way, e.g. it may comprise a block of foam that may be slotted.

The wiper member may also be adjustable, where appropriate.

By way of example, the wiper member may be as described in US patent applications or patents Nos. 2005/0028834, 2005/0175394, 2004/0258453, U.S. Pat. Nos. 6,375,374, 6,328,495, 7,455,468, the content of which is incorporated herein by reference.

At least some and in particular all of the stem 4 to which the applicator member is fastened may be flexible, in particular in the proximity of the applicator member.

By way of example, the stem may comprise at least one flexible element 80, as shown in FIG. 7*a*, e.g. made of elastomer. The flexible element may present a shape that imparts flexibility, e.g. at least one annular groove 81, as shown in FIG. 7*b*. By way of example, the flexible element is as described in EP 1 917 883 A2 and may be made, at least in part, out of a material from the following list: elastomer material; thermoplastic; thermoplastic elastomer; low-density polyethylene (LDPE); polyvinyl chloride (PVC); polyurethane (PU); thermoplastic elastomer polyesters, in particular copolymers of esterified polytetramethylene oxide glycol and butene terephthalate; Hytrel®; ethylene-propylene-diene terpolymer (EPDM); propylene-diene terpolymer (PDM); ethyl vinyl acetate (EVA); styrene-isoprene-styrene (SIS); styrene-ethylene-butylene-styrene (SEBS); styrene-butadiene-styrene (SBS); latex; silicone rubber; nitrile rubber; butyl rubber; polyurethane; polyether block amide; polyester; this list not being limiting. The flexible element 80 may be made of a material having hardness that lies in the range 25 on the Shore A scale (ShA) to 80 on the Shore D scale (ShD), for example, or even in the range 40 ShA to 70 ShD. The rigid portions of the stem may be made of a thermoplastic material, in particular one of the materials selected from the following list: high-density polyethylene (HDPE); LDPE; linear polyethylene (PE); polycrystalline (PT); polypropylene (PP); polyoxymethylene (POM); polyamide (PA); polyethylene terephthalate (PET); and polybutyl terephthalate (PBT); this list not being exhaustive.

The distal end of the applicator member 5 may optionally be offset relative to the longitudinal axis X, as described in application EP 1 836 924, for example.

The applicator member 5 may comprise a twisted core 10 formed by two twisted metal strands, the core being other than a core made of thermoplastic material, the core 10 having a proximal portion that is fastened in a housing of the stem 4, present at its distal end 4*a*, e.g. being force-fitted in the housing. By way of example, the two strands come from folding a wire in half. The strands of the core may be given a left-hand twist or a right-hand twist. The strands of the core may be of diameter lying in the range 0.35 mm to 1 mm, for example.

The brush may have a left-hand twist. On this topic, reference may usefully be made to European patent EP 611 170.

In a variant, the applicator member comprises a core made out of a thermoplastic material, and the applicator elements may be made out of a thermoplastic material that is identical to the thermoplastic material of the core, or that differs therefrom.

The core of the applicator member may extend along a longitudinal axis that is curved.

Naturally, the invention is not limited to the embodiments described above.

Characteristics described in relation with different embodiments may be combined with one another.

The expression "comprising a" should be understood as meaning "comprising at least one", unless specified to the contrary.

The invention claimed is:

1. A device for applying a composition to human keratinous materials, the device comprising:

a container that is provided with a wiper member and that contains a cosmetic or care-product composition;

an applicator for applying the composition contained in the container, the applicator comprising:

an applicator member for applying the composition;

a handle; and a stem that connects the applicator member to the handle, the stem extending along a longitudinal axis and comprising a visible portion that presents a cross-section that varies over more than half of its length, and that passes through at least one maximum that is situated at a non-zero distance from the ends of the visible portion, the device being configured such that the wiper member wipes the stem when the applicator is separated from the container.

2. A device according to the preceding claim 1, comprising a single maximum on a segment that extends axially over more than one-fourth of the length of the visible portion of the stem.

3. A device according to claim 1, wherein the maximum is situated between two minima of the cross-section of the visible portion of the stem.

4. A device according to claim 1, two successive minima being spaced apart by more than one-fourth of the length of the visible portion of the stem.

5. A device according to claim 1, the distance separating a minimum from a maximum being greater than one-fourth of the length of the visible portion of the stem.

6. A device according to claim 1, wherein at least one cross-section of the visible portion of the stem is of shape selected from the following list: circular; indented.

7. A device according to claim 1, wherein the greatest transverse dimension, e.g. the diameter for a stem of circular section, of the visible portion of the stem is greater than or equal to 5 mm.

8. A device according to claim 1, wherein, beside the handle, the cross-section of the visible portion of the stem passes through a minimum of cross-section that is smaller than the section of a wiper orifice of the wiper member.

9. A device according to claim 1, wherein, beside the applicator member, the cross-section of the visible portion of the stem passes through a minimum of section that is smaller than the section of a wiper orifice of the wiper member.

10. A device according to claim 1, wherein, the wiper member defines a wiper orifice of section that is smaller than the cross-section of the visible portion of the stem over more than one-fourth of its length.

11. A device according to claim 10, the cross-section at the maximum being greater than the section of the wiper orifice.

12. A device according to claim 1, the visible portion of the stem being obtained by molding.

13. A device according to claim 1, wherein the container is closed in leaktight manner by the handle of the applicator.

14. A device according to claim 1, the visible portion of the stem presenting a circular section of diameter passing from a value lying in the range 2 mm to 4 mm, e.g. 3 mm to 3.5 mm, to a value lying in the range 5.5 mm to 7 mm, then to a value lying in the range 2 mm to 4 mm, e.g. 3 mm to 3.5 mm, on going from one end of the visible portion to the other.

15. A device according to claim 14, the wiper member having a wiper orifice of diameter lying in the range 3 mm to 5.5 mm.

16. A device for applying a composition to human keratinous materials, the device comprising:

a container that is provided with a wiper member and that contains a cosmetic or care-product composition;

an applicator for applying the composition contained in the container, the applicator comprising:

an applicator member for applying the composition;

a handle; and a stem that connects the applicator member to the handle, the stem extending along a longitudinal axis and comprising a visible portion that presents a cross-section that varies over more than half of its length, and that passes through a single maximum that is situated at a non-zero distance from the ends of the visible portion and two minima, the slope angle formed between the minima and the maximum being less than 30°, the device being configured such that the wiper member wipes the stem when the applicator is separated from the container.

17. A device for applying a composition to human keratinous materials, the device comprising:

a container that is provided with a wiper member and that contains a cosmetic or care-product composition;

an applicator for applying the composition contained in the container, the applicator comprising:

an applicator member for applying the composition;

a handle; and a stem that connects the applicator member to the handle, the stem extending along a longitudinal axis and comprising a visible portion that presents a cross-section that varies over more than half of its length, and that passes through at least one maximum that is situated at a non-zero distance from the ends of the visible portion, the visible portion of the stem comprising two oppositely-directed conical portions that touch at their bases and that extend on either side of the maximum, the device being configured such that the wiper member wipes the stem when the applicator is separated from the container.

18. A device for applying a composition to human keratinous materials, the device comprising:

a container that is provided with a wiper member and that contains a cosmetic or care-product composition;

an applicator for applying the composition contained in the container, the applicator comprising:

an applicator member for applying the composition;

a handle; and a stem that connects the applicator member to the handle, the stem extending along a longitudinal axis and comprising a visible portion that presents a cross-section that varies over more than half of its length, and that passes through at least one maximum that is situated at a non-zero distance from the ends of the visible portion, the visible portion of the stem being hourglass-shaped, the device being configured such that the wiper member wipes the stem when the applicator is separated from the container.

* * * * *